US011653698B2

(12) United States Patent
Ouyang

(10) Patent No.: US 11,653,698 B2
(45) Date of Patent: May 23, 2023

(54) ELECTRONIC CIGARETTE PROVIDING A DETACHABLE CONNECTION BETWEEN AN ATOMIZING DEVICE AND A POWER SUPPLY UNIT

(71) Applicant: HONG KONG IVPS INTERNATIONAL LIMITED, Central (HK)

(72) Inventor: Junwei Ouyang, Shenzhen (CN)

(73) Assignee: Hong Kong IVPS International Limited, Central (HK)

( * ) Notice: Subject to any disclaimer, the term of this patent is extended or adjusted under 35 U.S.C. 154(b) by 391 days.

(21) Appl. No.: 17/006,956

(22) Filed: Aug. 31, 2020

(65) Prior Publication Data

US 2021/0059304 A1 Mar. 4, 2021

(30) Foreign Application Priority Data

Sep. 2, 2019 (CN) ..... 201921443572.1

(51) Int. Cl.
*A24F 40/40* (2020.01)

(52) U.S. Cl.
CPC ..... *A24F 40/40* (2020.01)

(58) Field of Classification Search
CPC ..... A24F 40/40; A24F 40/05
See application file for complete search history.

(56) References Cited

U.S. PATENT DOCUMENTS

| | | | | |
|---|---|---|---|---|
| 11,464,257 | B2 * | 10/2022 | Ouyang | A24F 40/40 |
| 2017/0027228 | A1 * | 2/2017 | Rastogi | A24F 40/40 |
| 2020/0323263 | A1 * | 10/2020 | Liu | A24F 40/05 |
| 2020/0404964 | A1 * | 12/2020 | Ouyang | A24F 40/40 |

* cited by examiner

*Primary Examiner* — Hae Moon Hyeon
(74) *Attorney, Agent, or Firm* — Thompson Hine LLP

(57) ABSTRACT

The present disclosure discloses an electronic cigarette that includes a power supply unit that includes an installation slot and an elastic limit stop, and an atomizing device. A portion of the elastic limit stop is partly protruding the installation slot and the protruded portion of the elastic limit stop is configured to slide relatively along a direction perpendicular to an installation direction of the atomizing device. When the atomizing device is installed in the installation slot, the elastic limit stop is configured to buckle on the atomizing device and the atomizing device can be detachably connected to the power supply unit. When sliding the elastic limit stop, the elastic limit stop is configured to detach from the atomizing device and the atomizing device can be removed from the installation slot.

10 Claims, 7 Drawing Sheets

ELECTRONIC CIGARETTE PROVIDING A DETACHABLE CONNECTION BETWEEN AN ATOMIZING DEVICE AND A POWER SUPPLY UNIT

CROSS-REFERENCE TO RELATED APPLICATION

This application claims priority to Chinese Patent Application No. 201921443572.1, filed on Sep. 2, 2019. The disclosure of the foregoing application is incorporated herein by reference in its entirety.

TECHNICAL FIELD

The present disclosure is related to the field of electronic cigarettes, particularly an electronic cigarette.

BACKGROUND

The electronic cigarettes in prior arts include integrated electronic cigarettes and split-type electronic cigarettes, wherein power supply unit and atomizing device are assembled in a detachable manner in the split-type electronic cigarettes, and the atomization device will be installed in the power supply device when the electronic cigarette is used. The power supply unit is usually provided with an installation slot for the installation of the atomizing device, and the atomizing device is fastened with magnetic attraction or interference fit to prevent the atomizing device from falling out of the installation slot. However, in the magnetic attraction method, the magnetic force is needed to match with the atomizing device, and the cost is high; in the interference fit method, the interference degree is difficult to control, which makes the atomizing device attached too tight or too loose, resulting in the atomization device is easy to fall out or is hard to be taken out. Therefore, the electronic cigarettes in prior arts need to be modified and improved.

SUMMARY

The present disclosure mainly provides an electronic cigarette, aiming to improve the reliability of a detachable connection between the atomizing device and the power supply unit of the electronic cigarette.

The technical solutions adopted by the present disclosure to achieve the above purpose are described as below:

An electronic cigarette, which comprises a power supply unit provided with an installation slot and an atomizing device. The power supply unit is provided with an elastic limit stop; the elastic limit stop is partly protruding in the installation slot, and protruded part can slide relatively along the direction perpendicular to the installation direction of the atomizing device. When the atomizing device is installed in the installation slot, the elastic limit stop will be buckled on the atomizing device, so that the atomizing device can detachably connect to the power supply unit; when sliding the elastic limit stop, the elastic limit stop will detach from the atomizing device, so that the atomizing device may be removed from the installation slot.

The electronic cigarette, wherein the elastic limit stop comprises a base with an accommodation slot and a limit stop body that is rotatably connected to the base and partly accommodated in the accommodation slot. A first buckle is provided on one side of the limit stop body, and the first buckle passes through the first side wall of the accommodation slot and protrude into the installation slot. When the limit stop body is rotating, the limit stop body will drive the first buckle to slide along the direction perpendicular to the installation direction of the atomizing device.

The electronic cigarette, wherein the atomizing device is provided with a second buckle that matches with the first buckle. When the atomizing device is installed in the installation slot, the first buckle will be above the second buckle and abut against the second buckle, so as to lock the atomizing device in the installation slot; when the limit stop body rotates relative to the base under external force, the first buckle will be driven to slide and completely accommodate in the accommodation slot, so that the first buckle can detach from the second buckle to unlock the atomizing device from the installation slot.

The electronic cigarette, wherein the first buckle comprises a first abutting surface and a first guiding surface. The first abutting surface is perpendicular to the installation direction of the atomizing device, and the first guiding surface forms a tilt angle relative to the installation direction of the atomizing device. When the atomizing device is installed, the second buckle will slide along the first guiding surface till the location below the first abutting surface is reached to abut against the first abutting surface.

The electronic cigarette, wherein the limit stop body is provided with a rotating shaft. Rotating shaft holes are provided on a second side wall and a third side wall that opposite to the accommodation slot; either end of the rotating shaft passes through corresponding rotating shaft hole respectively; and with the cooperation between the rotating shaft and rotating shaft hole, the limit stop body will rotate in the accommodation slot under external force.

The electronic cigarette, wherein the electronic cigarette further includes an elastic part. One end of the elastic part is elastically abutted against one side of the first buckle that is away from the limit stop body, and the other end is elastically abutted against the fourth side wall of the accommodation slot.

The electronic cigarette, wherein opening direction of the accommodation slot is the same as the opening direction of the installation slot, and surface of the opening of the accommodation slot extends along the rotating track of the limit stop body.

The electronic cigarette, wherein one end of the limit stop body extends out of the opening of the accommodation slot to form a buckle part. One side of the buckle part close to the accommodation slot attaches to the surface of the opening of the accommodation slot; the buckle part slides on the surface of the opening of the accommodation slot under external force, so as to drive the elastic part body to rotate relative to the base.

The electronic cigarette, wherein a third buckle is convexly provided on the side of the installation slot; correspondingly, a buckle slot matching with the third buckle is provided on the atomizing device. When the elastic limit stop is buckled on the atomizing device, the third buckle will be buckled on the slot.

The electronic cigarette, wherein the elastic limit stop and the third buckle are respectively provided on two opposite ends of the installation slot.

Advantages: the present disclosure discloses an electronic cigarette, which comprises a power supply unit provided with an installation slot and an atomizing device. The power supply unit is provided with an elastic limit stop; the elastic limit stop is partly protruding in the installation slot, and protruded part can slide relatively along the direction perpendicular to the installation direction of the atomizing device. When the atomizing device is installed in the installation slot, the elastic limit stop will be buckled on the atomizing device, so that the atomizing device is detachably connected to the power supply unit; when the elastic limit stop is sliding, the elastic limit stop will detach from the atomizing device, so that the atomizing device may be removed from the installation slot. In this present disclosure, an elastic limit stop matching with the atomizing device is provided on the power supply, and the elastic limit stop will buckle on the atomizing device when the atomizing device is inside the installation slot, which will prevent the atomizing device from sliding out of the installation slot as well as improve the reliability of installation of atomizing device.

DESCRIPTION OF THE DRAWINGS

For more complete understanding of the present disclosure, the drawings in the embodiments are briefly introduced. Obviously, the drawings in the following description are only some embodiments of the present disclosure, it will be apparent to those skilled in the art from this disclosure that other drawings may be easily obtained from these drawings without paying any creative effort.

DEFINITION OF REFERENCE NUMBERS

Figure 1:
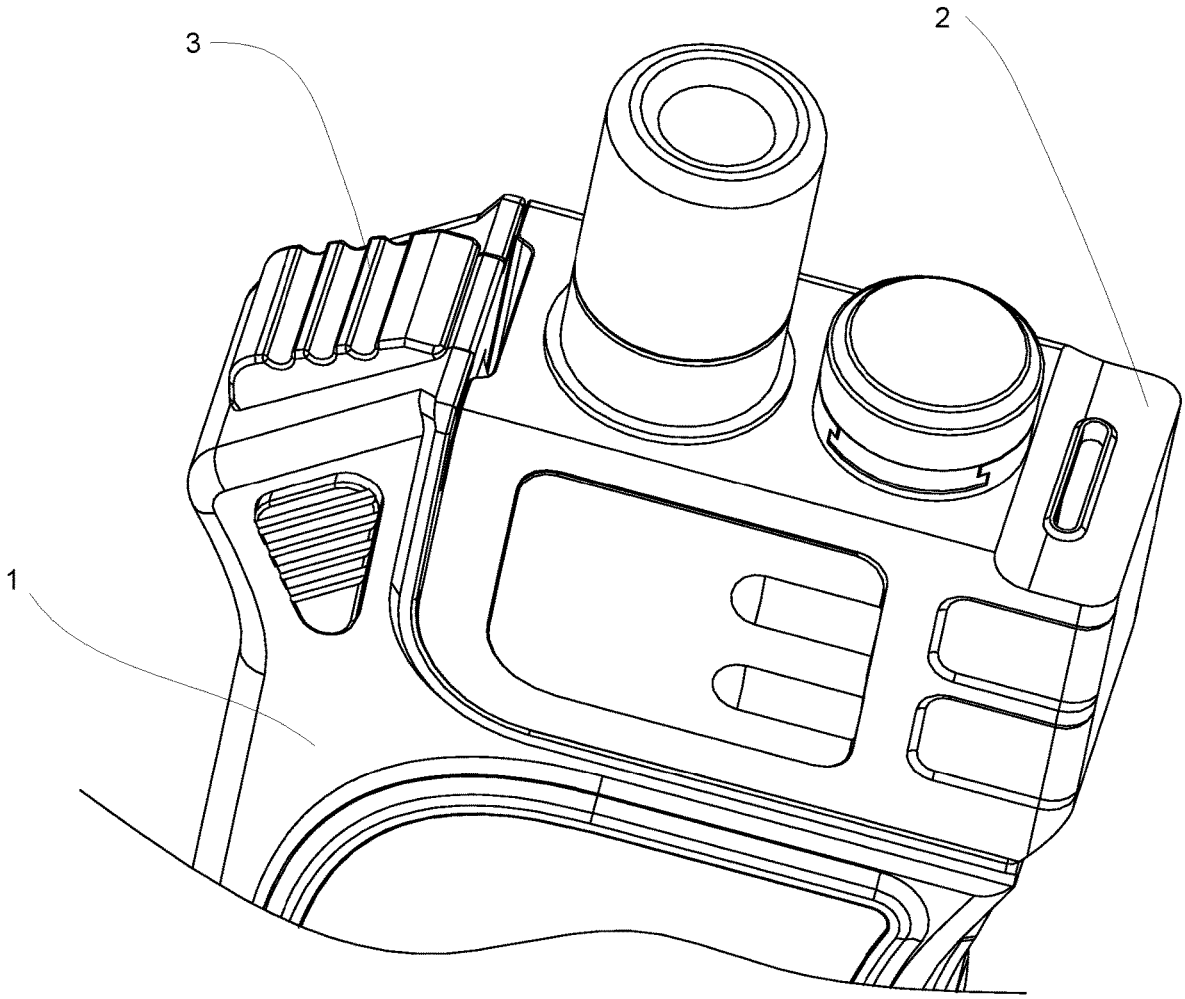
FIG. 1 is the perspective view of preferred embodiment of the electronic cigarette disclosed in the present disclosure.

| Label | Name | Label | Name |
|---|---|---|---|
| 1 | Power supply unit | 2 | Atomizing device |
| 3 | Elastic limit stop | 11 | Installation slot |
| 12 | Third buckle | 21 | The second buckle |
| 22 | Clearance groove | 23 | Buckle slot |
| 211 | Second abutting surface | 212 | Second guiding surface |
| 31 | Limit stop body | 32 | Base |
| 33 | Elastic part | 311 | First Buckle |
| 312 | Rotating Shaft | 313 | Buckle part |
| 314 | First installation post | 315 | Rotating shaft hole |
| 3111 | First guiding surface | 3112 | First abutting surface |
| 321 | Accommodation slot | 3211 | First side wall |
| 3212 | Fourth side wall | 3213 | Through hole |
| 3214 | Second installation post | 3131 | Stress surface |
| 3132 | Third guiding surface | | |

The realization of objects, functional characteristics, and advantages of the present disclosure will be further described in conjunction with the embodiments and with reference to the drawings.

DETAILED DESCRIPTION

Technical solutions based on embodiments of the present disclosure are described clearly and completely in conjunction with the drawings in the embodiments of the present disclosure hereinafter. Any described embodiment is only a part of embodiments of the present disclosure. Other embodiments obtained by those skilled in the art without any creative work based on embodiments of the present disclosure fall within the scope of protection of the present disclosure.

It should be noted that all directional indicators (such as up, down, left, right, front, back, etc.) in embodiments of the present disclosure are only used to explain the relative position between the components in a specific posture (as shown in the drawings) and movement conditions, etc.; if the specific posture changes, the directional indication also changes accordingly.

In the description of the present application, the "first" and "second" are merely used for description but cannot be understood as indication or implication related to importance or implicit indication for the number of the indicated technical features. Therefore, features with a limitation of "first" or "second" can explicitly or implicitly include one or more feature. Furthermore, technical schemes of various embodiments can be combined with each other if only it can be implemented by those of ordinary skill in the art. If a combination of the technical schemes is conflict or impracticable, the combination should be considered as not exist and not fall in the scope of protection of the present disclosure.

In the present disclosure, unless otherwise clearly stated and limited, terms "connect" and "fix" should be understood broadly; for instance, "fix" can be a fixed connection, a detachable connection, or an integral connection; can be a mechanical connection, also can be an electrical connection; can be a direct connection, can be an indirect connection by an intermediary, and can be an internal communication of two elements, unless otherwise clearly limited. A person skilled in the art can understand concrete meanings of the terms in the present disclosure as per specific circumstances.

Figure 2:
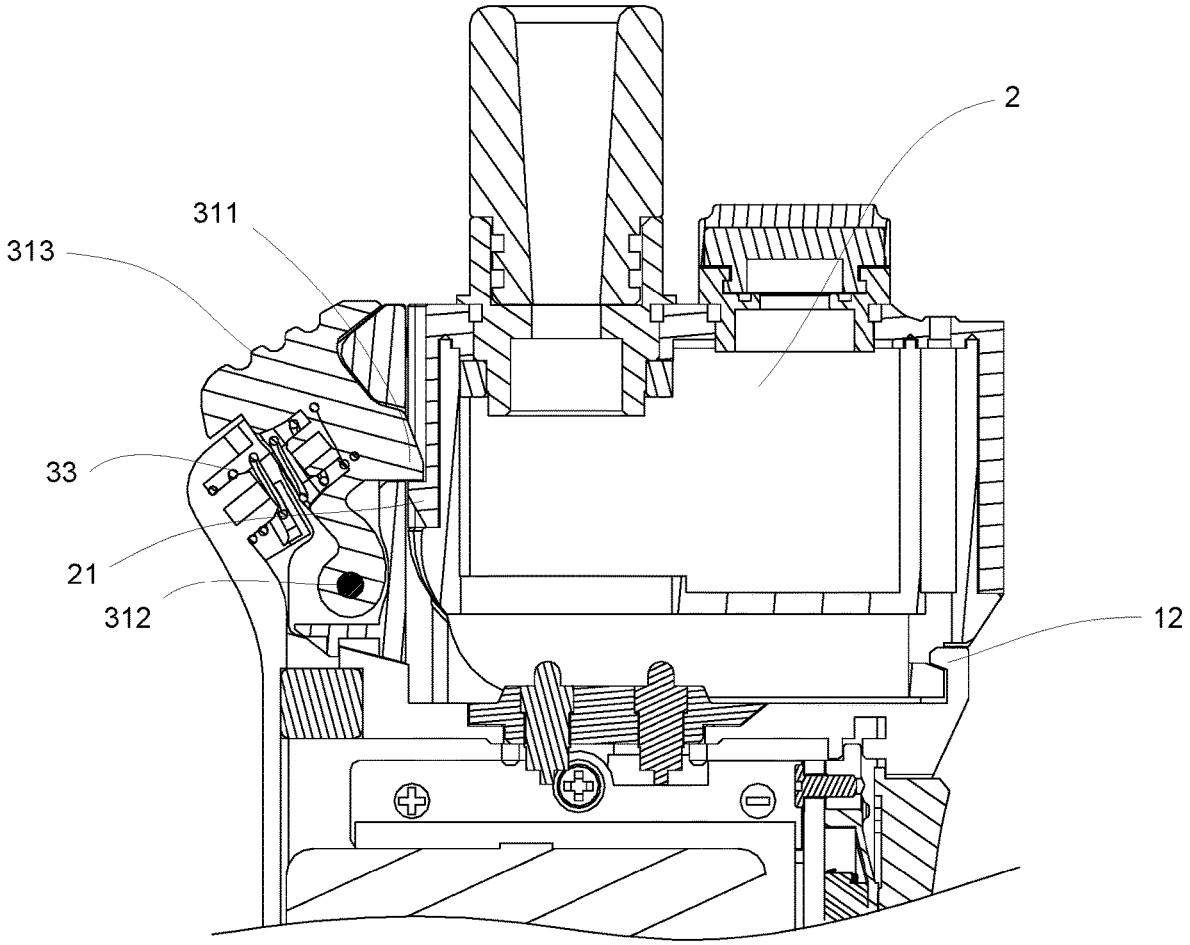
FIG. 2 is the section view of preferred embodiment of the electronic cigarette disclosed in the present disclosure.

Refer to FIG. 1 and FIG. 2. FIG. 1 is the perspective view of preferred embodiment of the electronic cigarette disclosed in the present disclosure, and FIG. 2 is the section view of preferred embodiment of the electronic cigarette disclosed in the present disclosure. The electronic cigarette comprises a power supply unit 1 provided with an installation slot 11 and an atomizing device 2. The power supply unit 1 is provided with an elastic limit stop 3; the elastic limit stop 3 is partly protruding in the installation slot 11, and protruded part can slide relative to the installation slot 11 along the direction perpendicular to the installation direction of the atomizing device 2. When the atomizing device 2 is installed in the installation slot 11, the elastic limit stop 3 will be buckled on the atomizing device 2, so that the atomizing device 2 will detachably connect to the power supply unit 1.

When the elastic limit stop 3 is sliding, the elastic limit stop 3 will detach from the atomizing device 2, so that the atomizing device 2 may be removed from the installation slot 11. In this present disclosure, an elastic limit stop 3 matching with the atomizing device 2 is provided on the power supply unit 1, and the elastic limit stop 3 will buckle on the atomizing device 2 when the atomizing device 2 is inside the installation slot 11, which will prevent the atomizing device 2 from sliding out of the installation slot 11 as well as improve the reliability of installation of atomizing device. When the atomizing device 2 needs to be taken out, users only need to slide the elastic limit stop 3 to separate it from the atomizing device 2, which is easy to operate.

Figure 3:
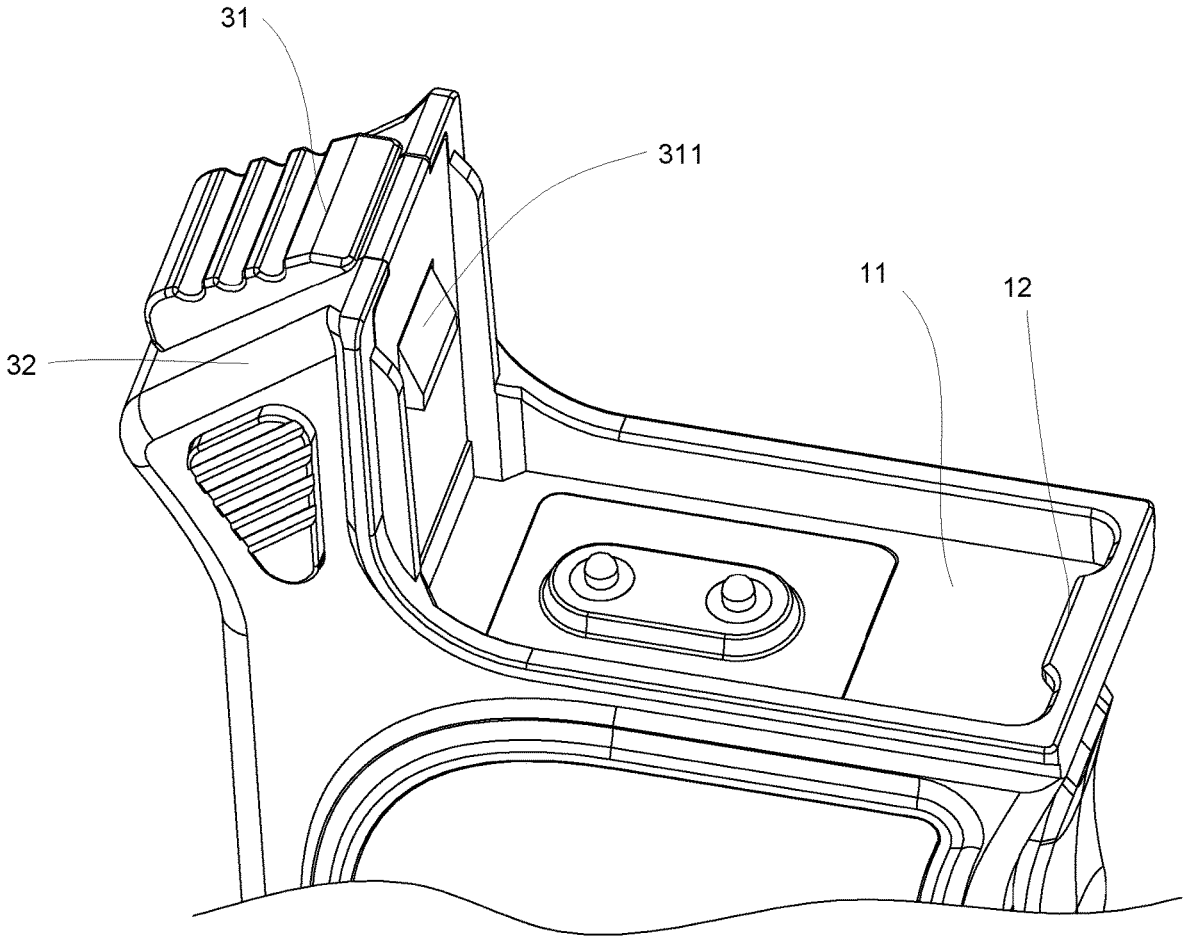
FIG. 3 is a perspective view of the power supply unit in preferred embodiment of the electronic cigarette disclosed in the present disclosure.

In this embodiment, as shown in FIG. 2 and FIG. 3, the power supply unite 1 is provided with an installation slot 11. The installation slot 11 includes a bottom wall and four side walls, and side walls of the above mentioned four side walls are connected in sequence, and the shape of the enclosure is adapted to the atomizing device 2. When the atomizing device 2 is accommodated in the installation slot 11, four side walls of the installation slot 11 will attach to the corresponding outer surface of the atomizing device 2, so as to limit the displacement along horizontal direction of the atomizing device 2 and prevent the atomizing device 2 from shaking.

Refer to FIG. 2-FIG. 5, the embodiment prevents the atomizing device 2 from falling out of the opening end 111 of the installation slot 11 (e.g., limit the atomizing device 2 to move along vertical direction) by the elastic limit stop 3. Specifically, the elastic limit stop 3 comprises a base 32, a limit stop body 31, and an elastic part 33. The base 32 is provided with an accommodation slot 321, and the opening direction of the accommodation slot 321 is the same as the opening direction of the installation slot 11. The accommodation slot 321 comprise a bottom wall (not shown in the figures), a first side wall 3211, a second side wall 3215, a third side wall (not shown in the figures), and a fourth side wall 3212. Wherein, the bottom is opposite to the opening of the accommodation slot 321; the first side wall 3211 is close to the installation slot 11; the fourth side wall 3212 is opposite to the first side wall 3211; the second side wall 3215 and the third side wall are opposite to each other and are connected to the first side wall 3211 respectively. The limit stop body 31 is partly accommodated in the accommodation slot 321, and one end of which is exposed from the opening of the accommodation slot 321 for users to exert effort. The part of the limit stop body 31 that is accommodated in the accommodation slot 321 is rotatably connected to the base 32; when exert force on exposed part, the part inside the accommodation slot 321 will be driven to rotate. Specifically, a rotating shaft 312 is provided on the limit stop body 31; rotating shaft holes 315 matching with the rotating shaft 312 are provided on the second side wall 3215 and the third side wall, and two ends of the rotating shaft 312 pass through the corresponding rotating shaft holes 315 respectively. Through the cooperation between the rotating shaft 312 and rotating shaft holes 315, the limit stop body 31 and the base 32 are rotatably connected and may rotate inside the accommodation slot 321. In practice, the rotating shaft 312 may be fixed on the limit stop body 31 and be rotatably connected to the two rotating shaft holes 315; when exerting force is on the exposed part of the limit stop body 31, the rotating shaft 312 will be driven to rotate inside the rotating shaft hole 315. Of course, the rotating shaft 312 may also be rotatably connected to the limit stop body 31 and be fixed on the two rotating shaft holes 315; when exerting force on exposed part of the limit stop body 31, the limit stop body 31 will rotate around the rotating shaft 312.

Figure 4:
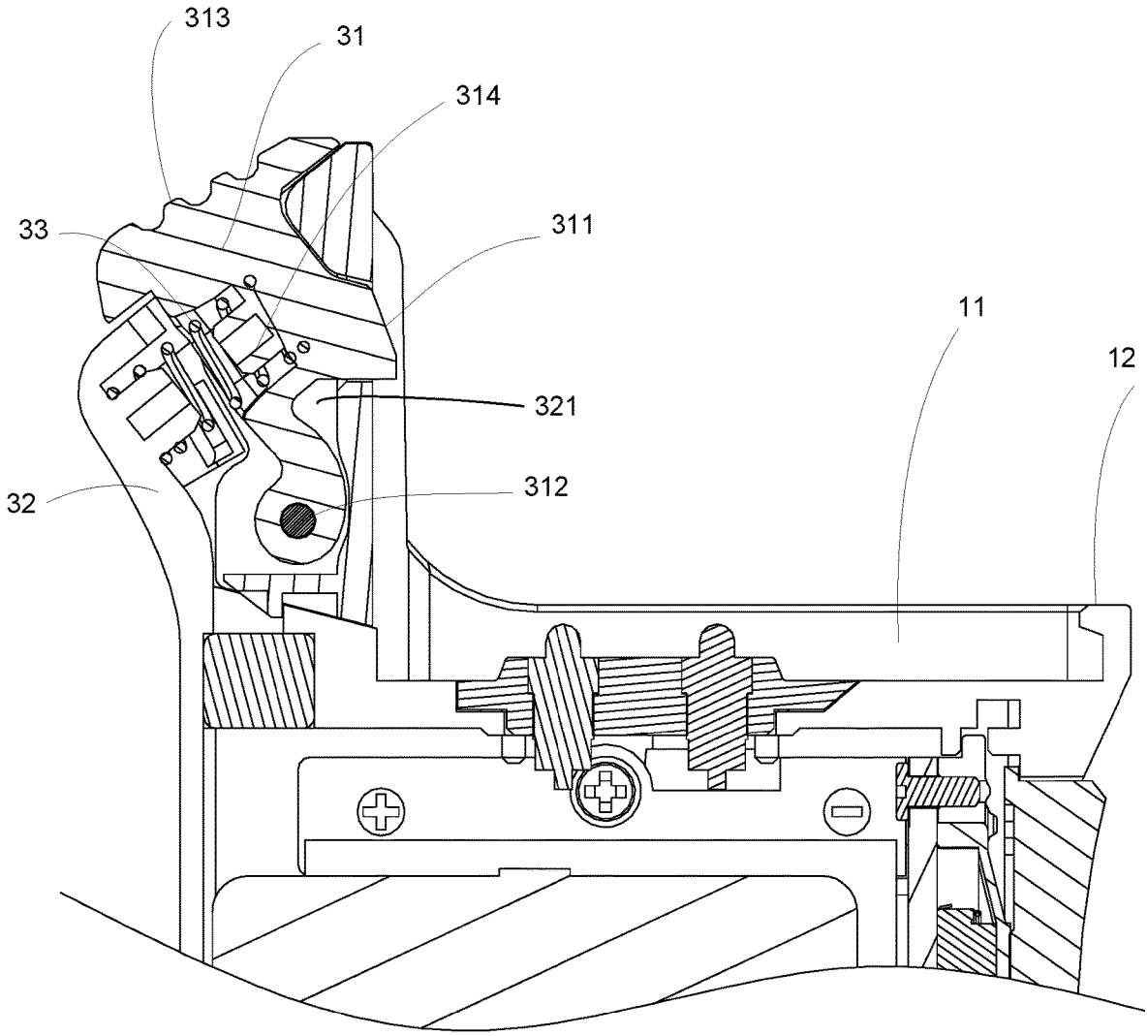
FIG. 4 is a section view of the power supply unit in preferred embodiment of the electronic cigarette disclosed in the present disclosure.
Figure 5:
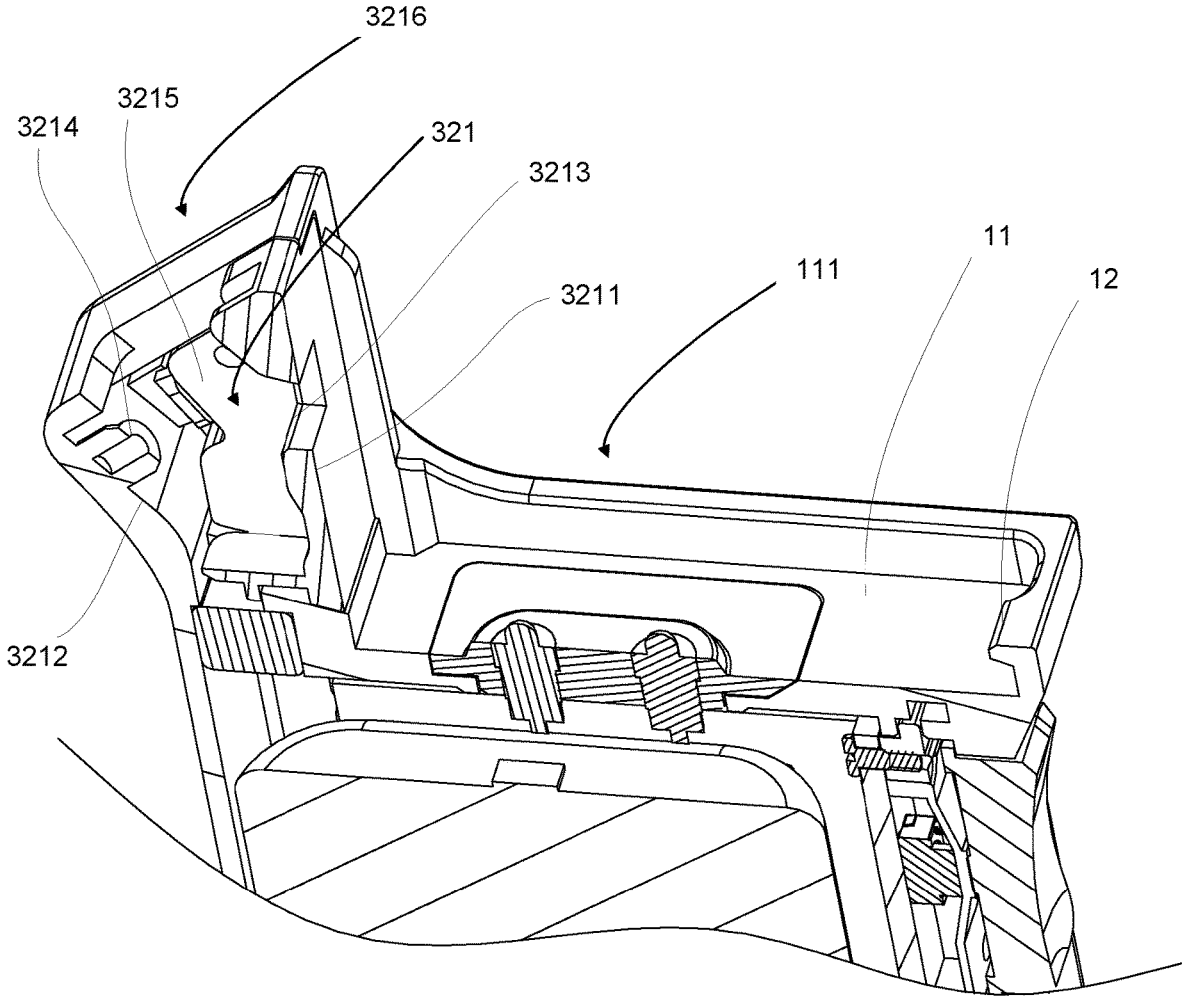
FIG. 5 is the schematic view of the base in preferred embodiment of the electronic cigarette disclosed in the present disclosure.

In this embodiment, as shown in FIG. 2 and FIG. 4, a first buckle 311 is provided on one side of the limit stop body 31, and the first buckle 311 passes through the first side wall 3211 to protrude in the installation slot 11. Correspondingly, a through hole 3213 matching with the first buckle 311 is provided on the first side wall 3211, and the through hole 3213 communicates with the installation slot 11 and the accommodation slot 321. The side of the limit stop body 31 away from the first buckle 311 is connected to the elastic part 33. One end of the elastic part 33 is elastically abutted against the limit stop body 31, and the other end is elastically abutted against the fourth side wall 3212 of the accommodation slot 321. The limit stop body 31 clearance fits with the accommodation slot 321, and one side of the limit stop body 31 is pressed towards the first side wall 3211 by the elastic part 33 and is abutted against the first side wall 3211. Correspondingly, the other side opposing to the limit stop body 31 is elastically abutted against the fourth side wall 3212 through the elastic part 33, that is, there is gap between the limit stop body 31 and the fourth side wall 3212. The minimum gap between the limit stop body 31 and the fourth side wall 3212 limits the rotation stroke of the limit stop body 31.

In practice, the elastic part 33 is a spring. A first installation post 314 is convexly provided on the limit stop body 31 where towards the fourth side wall 3212, and a second installation post 3214 is provided on the fourth side wall 3212; one end of the elastic part 33 is sleeved on the first installation post 314, and the other end is sleeved on the second installation post 3214; the telescopic direction of the elastic part 33 is guided by the two installation posts to prevent from displacement of the elastic part 33. When external force is on the part of the limit stop body 31 exposed out of the opening end 3216 of the accommodation slot 321, the limit stop body 31 will rotate counterclockwise inside the accommodation slot 321 and presses the elastic part 33 towards the fourth side wall 3212, so as to compress the elastic part 33 further; at the same time, the limit stop body 31 drives the first buckle 311 slide towards the accommodation slot 321 along the direction that perpendicular to the installation direction of the atomizing device 2 till the first buckle 311 is completely accommodated in the accommodation slot 321. When the external force exerted on the limit stop body 31 is removed, elastic deformation of the elastic part 33 will be recovered, and a thrust force towards the installation slot 11 will be applied on the limit stop body 31; the limit stop body 31 will rotate clockwise and drive the first buckle 311 to slide along the through hole 3213 until protruding in the installation slot 11.

Furthermore, as shown in FIG. 4, surface of the opening end 3216 of the accommodation slot 321 extends along the rotating track of the limit stop body 31; that is, the plane of the open end coincides with the rotation track of the limit stop body 31. Correspondingly, the part of the limit stop body 31 exposed out of the opening end 3216 extends out of the opening of the opening end 3216 to form a buckle part 313 for users to exert effort. The buckle part 313 comprises a third guiding surface 3132 and a stress surface 3131. Wherein, the third guiding surface 3132 is on the side of the buckle part 313 where close to the accommodation slot 321, and the guiding surface 3132 is attached to the plane of the opening end 3216 of the accommodation slot 321; that is, the extension direction of the third guide surface 3132 is also adapted to the rotation track of the limit stop body 31. The stress surface 3131 is the surface of the buckle part 313 that is exposed for user to exert effort. When external force is on the stress surface 3131, the third guiding surface 3132 will slide along the plane of the opening end 3216, so that the limit stop body 31 can rotate and further drive the first buckle 311 slide into the accommodation slot 321 to detach from the atomizing device 2, so as to unlock the atomizing device 2; then the atomizing device 2 can be removed. In practice, the stress surface 3131 is a plane extending diagonally downward, which facilitate users to operate when holding the electronic cigarette and sliding the buckle part 313. The locking and unlocking structure not only improve reliability of installation of the atomizing device 2, avoid power failure of the atomizing device 2 due to maloperation, or fall out under external force; but also make the buckle part 313 ergonomic and user friendly. Furthermore, at least one slot or convex is provided on the stress surface 3131 to improve roughness of the stress surface 3131 and prevent slipping when the stress surface 3131 is operated by users.

Figure 6:
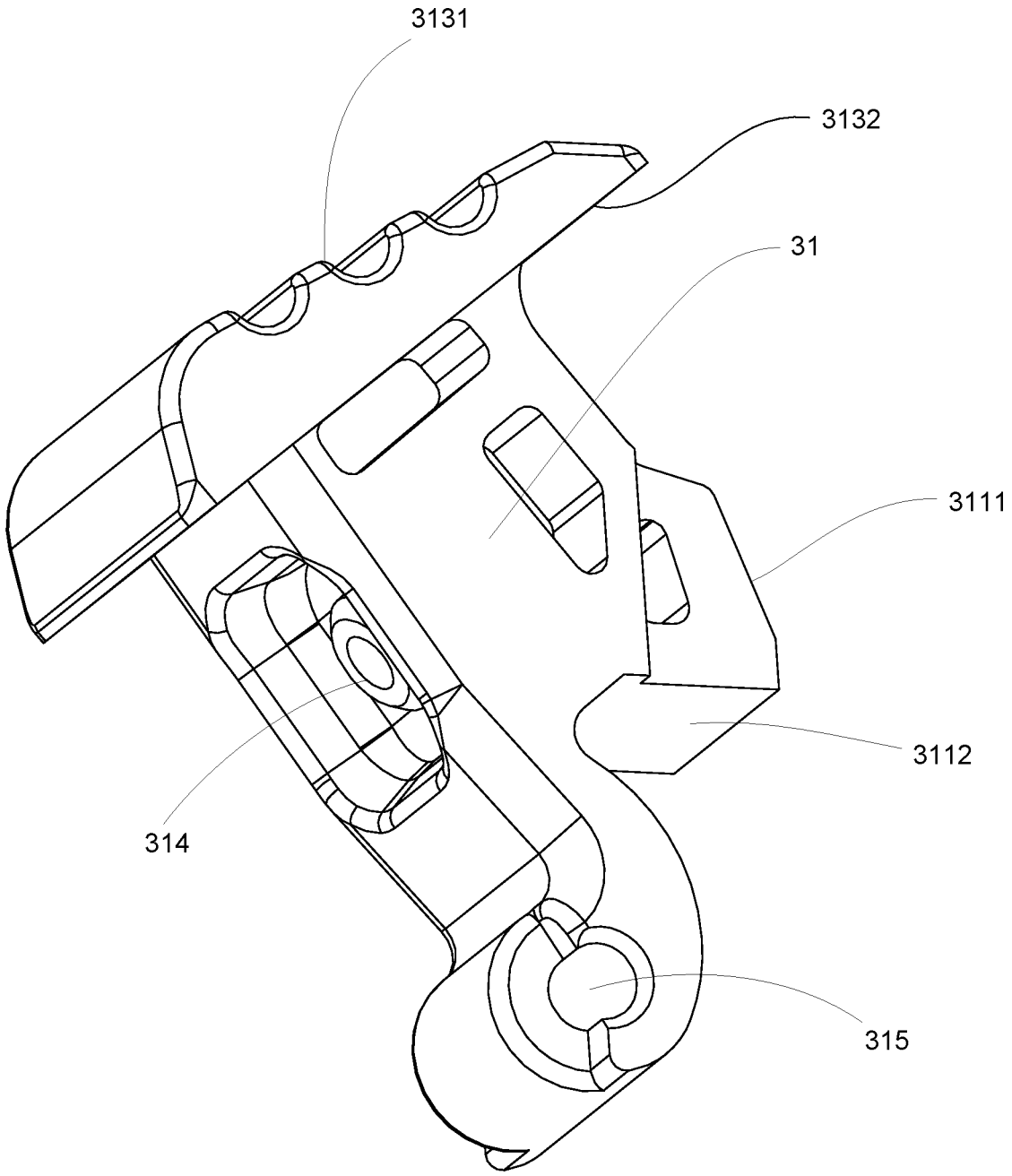
FIG. 6 is the schematic view of limit stop body in preferred embodiment of the electronic cigarette disclosed in the present disclosure.
Figure 7:
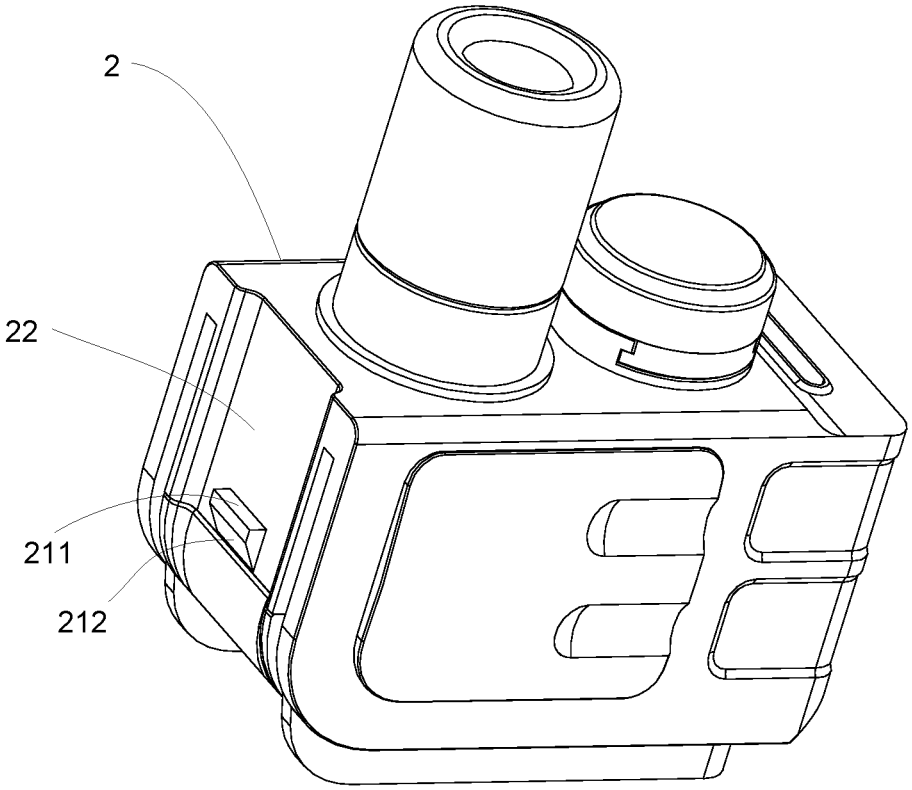
FIG. 7 is a first angle schematic view of the atomizing device in preferred embodiment of the electronic cigarette disclosed in the present disclosure.

In this embodiment, refer to FIG. 2, FIG. 6 and FIG. 7, a second buckle 21 that matches with the first buckle 311 is provided on the atomizing device 2. The first buckle 311 comprises a first abutting surface 3112 and a first guiding surface 3111; the first abutting surface 3112 is perpendicular to the installation direction of the atomizing device 2 and attaches to the wall of the through hole 3213. The first guiding surface 3111 forms a tilt angle with the installation direction of the atomizing device 2. The second buckle 21 comprises a second abutting surface 211 and a second guiding surface 212. The second abutting surface 211 is parallel to the first abutting surface 3112, and the second guiding surface 212 is parallel to the first guiding surface 3111.

When the atomizing device 2 is installed downward from the notch of the installation slot 11, the second guide surface 212 will move downward while sliding along the first guiding surface 3111 and exerts a pushing force on the first guiding surface 3111, so that the first buckle 311 is completely pushed into the accommodation slot 321, while the elastic part 33 is compressed. When the atomizing device 2 continues to move down till the bottom of the atomizer is abutted against the bottom wall of the installation slot 11, the second guiding surface 212 will slide to separate from the first guiding surface 3111 then locate below the first guiding surface 3111, and the second abutting surface 211 will be attached to the first abutting surface 3112 and (the second abutting surface 211) locate below the first abutting surface 3112. When the atomizer is pulled upward, the first abutting surface 3112 will be abutted against the second abutting surface 211, so as to prevent the atomizer from falling out of the installation slot 11 and achieve reliable connection between the atomizer and power supply unit 1.

When the atomizing device 2 needs to be taken out of the installation slot 11, the stress surface 3131 of the buckle part 313 will slide and drive the limit stop body 31 to rotate counterclockwise, so that the first buckle 311 can slide along the through hole 3213 from the installation slot 11 into the accommodation slot 321 and separate from the second buckle 21, which unlock the atomizing device 2; and the atomizing device 2 can be taken out from the installation slot 11. In this embodiment, the elastic limit stop 3 and the atomizing device 2 are reliably matched to lock the atomizing device 2, which reduces the probability of falling out of the atomizing device 2.

In one embodiment of the present disclosure, as shown in FIG. 2 and FIG. 7, a clearance groove 22 is provided on one side of the atomizing device 2 where the second buckle 21 is provided. The second buckle 21 is connected to the bottom surface of the clearance groove 22 and is convexly provided in the clearance groove 22. When the atomizing device 2 is installed in the installation slot 11 and the second buckle 21 is buckled with the first buckle 311, the clearance groove 22 and the power supply unit 1 will form an air intake channel that communicates with the atomization channel, and the first buckle 311 and the second buckle 21 will be accommodated in the air intake channel. In order to ensure the unobstructed air intake of the air intake channel, preferably, the widths of the first buckle 311 and the second buckle 21 are both smaller than the width of the air intake channel to prevent the air intake channel from being blocked and affecting intake airflow.

Figure 8:
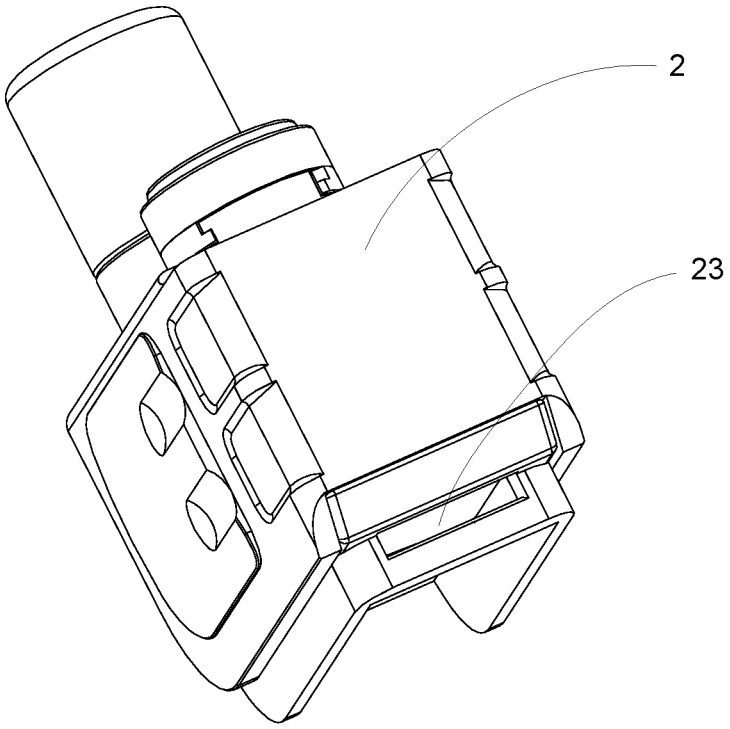
FIG. 8 is the second angle schematic view of the base in preferred embodiment of the electronic cigarette disclosed in the present disclosure.

In an embodiment of the present disclosure, as shown in FIG. 2 and FIG. 8, either side wall of the installation slot 11 or the atomizing device 2 is provided with a third buckle 12, and the other is provided with a slot 23 which matches with the third buckle 12. When the elastic limit stop 3 is buckled on the atomizing device 2, the third buckle 12 will be buckled on the slot 23. In practice, the third buckle 12 is provided on side wall of the installation slot 11; correspondingly, the slot 23 is provided on the atomizing device 2. Preferably, the third buckle 12 is arranged at one end of the side wall of the installation slot 11 where close to the notch, and the exposed surface of the third buckle 12 is flush with the plane where the notch is located. The slot 23 could be a through slot or a non-through slot. Furthermore, the third buckle 12 and the elastic limit stop 3 are respectively arranged at two opposite ends of the installation slot 11, so that when the atomizing device 2 is placed inside the installation slot 11, two opposite ends of the atomizing device 2 both subject to buckle force, which makes the force on both ends of the atomizing device 2 balanced and improves the stability under the locked state.

The above only describes preferred embodiments of the present disclosure and is not intended to limit the patent scope of the present disclosure. Any equivalent structural transformation made by using contents of the description and drawings of the present disclosure, or directly or indirectly used in other relevant technical fields under the inventive concept of the present disclosure shall be included within the protection scope of patent of the present disclosure.

The invention claimed is:

1. An electronic cigarette comprising:

a power supply unit that includes an installation slot and an elastic limit stop; and and an atomizing device, wherein a portion of the elastic limit stop is partly protruding the installation slot and the protruded portion of the elastic limit stop is configured to slide relatively along a direction perpendicular to an installation direction of the atomizing device, wherein when the atomizing device is installed in the installation slot, the elastic limit stop is configured to buckle on the atomizing device and the atomizing device can be detachably connected to the power supply unit, wherein, when sliding the elastic limit stop by a user, the elastic limit stop is configured to detach from the atomizing device at the installation slot, and the atomizing device can be removed from the installation slot.

2. The electronic cigarette of claim 1, wherein the elastic limit stop comprises a base with an accommodation slot and a limit stop body that is rotatably connected to the base and partly accommodated in the accommodation slot, wherein a first buckle is provided on one side of the limit stop body, and the first buckle is configured to pass through a first side wall of the accommodation slot and protrude into the installation slot, wherein when the limit stop body is rotating, the limit stop body can drive the first buckle to slide along the direction perpendicular to the installation direction of the atomizing device.

3. The electronic cigarette of claim 2, wherein the atomizing device includes a second buckle that is matched with the first buckle, wherein when the atomizing device is installed in the installation slot, the first buckle is above the second buckle and abutted against the second buckle which locks the atomizing device in the installation slot, wherein when the limit stop body rotates relative to the base under external force, the first buckle is configured to be driven to slide and completely accommodated in the accommodation slot, so that the first buckle can be detached from the second buckle to unlock the atomizing device from the installation slot.

4. The electronic cigarette of claim 3, wherein the first buckle comprises a first abutting surface and a first guiding surface, wherein the first abutting surface is perpendicular to the installation direction of the atomizing device, and the first abutting surface and the first guiding surface form a tilt angle relative to the installation direction of the atomizing device, wherein when the atomizing device is installed, the second buckle is configured to slide along the first guiding surface till a location below the first abutting surface is reached to abut against the first abutting surface.

5. The electronic cigarette of claim 3, wherein either side wall of the installation slot or the atomizing device includes a third buckle, and the other includes a slot which matches the third buckle, wherein when the elastic limit stop is buckled on the atomizing device, the third buckle is configured to be buckled on the installation slot.

6. The electronic cigarette of claim 5, wherein the side wall of the installation slot includes the third buckle, and the elastic limit stop and the third buckle are respectively provided on two opposite ends of the installation slot.

7. The electronic cigarette of claim 2, wherein the limit stop body comprises a rotating shaft that includes rotating shaft holes that are provided on a second side wall and a third side wall, wherein two ends of the rotating shaft pass through corresponding rotating shaft holes respectively, wherein when under an external force, the limit stop body is configured to rotate in the accommodation slot through a cooperation between the rotating shaft and the corresponding rotating shaft holes.

8. The electronic cigarette of claim 7, wherein the elastic limit stop further comprises an elastic part, wherein one end of the elastic part is elastically abutted against one side of the first buckle that is away from the limit stop body, and the other end of the elastic part is elastically abutted against a fourth side wall of the accommodation slot.

9. The electronic cigarette of claim 2, wherein an opening direction of an opening of the accommodation slot is the same as an opening direction of an opening of the installation slot, and a surface of the opening of the accommodation slot extends along a rotating track of the limit stop body.

10. The electronic cigarette of claim 9, wherein one end of the limit stop body extends out of the opening on the accommodation slot to form a buckle part, wherein one side of the buckle part proximate to the accommodation slot is configured to attach to the surface of the opening of the accommodation slot, wherein when under an external force, the buckle part is configured to slide on the surface of the opening of the accommodation slot to drive the limit stop body to rotate relative to the base.

* * * * *